US007238237B2

(12) United States Patent
Tokimasa et al.

(10) Patent No.: US 7,238,237 B2
(45) Date of Patent: Jul. 3, 2007

(54) COATING APPARATUS AND COATING METHOD

(75) Inventors: Yasuhiko Tokimasa, Minami-Ashigara (JP); Akio Tsuji, Minami-Ashigara (JP); Yoshinobu Katagiri, Minami-Ashigara (JP)

(73) Assignee: Fujifilm Corporation, Tokyo (JP)

( * ) Notice: Subject to any disclaimer, the term of this patent is extended or adjusted under 35 U.S.C. 154(b) by 77 days.

(21) Appl. No.: 11/086,313

(22) Filed: Mar. 23, 2005

(65) Prior Publication Data

US 2005/0211164 A1 Sep. 29, 2005

(30) Foreign Application Priority Data

Mar. 25, 2004 (JP) ..... 2004-090171

(51) Int. Cl.
*B05C 3/02* (2006.01)

(52) U.S. Cl. ..... 118/410; 118/419

(58) Field of Classification Search ..... 29/405, 29/445; 118/DIG. 2, 410, 411, 419, 323, 118/325; 425/190, 461, 113, 378.1, 192 R
See application file for complete search history.

(56) References Cited

U.S. PATENT DOCUMENTS

| | | | | |
|---|---|---|---|---|
| 4,221,184 | A * | 9/1980 | Gref et al. | 118/412 |
| 5,143,758 | A * | 9/1992 | Devine | 427/420 |
| 5,275,660 | A * | 1/1994 | Ozaki et al. | 118/411 |

FOREIGN PATENT DOCUMENTS

| | | |
|---|---|---|
| JP | 5-111672 | 5/1993 |
| JP | 2000-176343 | 6/2000 |
| JP | 2003-112100 | 4/2003 |

* cited by examiner

*Primary Examiner*—Brenda A. Lamb
(74) *Attorney, Agent, or Firm*—Young & Thompson

(57) ABSTRACT

The mounting is formed by grinding an integrally molded material with accuracy of the μm order. An upper portion of the mounting is an L-shaped holding portion on which a slot die is positioned. An upper face of the holding portion contacts a lower face of the slot die, and a side face of the holding portion contacts a rear face of the slot die. The lower and rear faces of the slot die and the upper and side faces of the holding portion are formed to have such a straightness for the total length that the unevenness thereof may be in 5 μm. Thus the slot die can be held with high accuracy, and the clearance accuracy between the lips and a web can be increased.

11 Claims, 3 Drawing Sheets

FIG.3

| | MOUNT | MAIN BODY OF BLOCK | LIPS | BOLT POSITION FROM EDGES | FASTEN | CLEARANCE DIFFERENCE | |
|---|---|---|---|---|---|---|---|
| | | | | | | BEFORE COATING | AFTER COATING |
| EXAMPLE 1 | MOLDING | SUS630 | HA | 200, 750, 1300 (mm) | ONE FACE | 3 (μm) | 10 (μm) |
| EXAMPLE 2 | MOLDING | SUS630 | HA | 90, 370, 750, 1130, 1410 (mm) | ONE FACE | 3 (μm) | 6 (μm) |
| EXAMPLE 3 | MOLDING | SUS630 | HA | 0, 370, 750, 1130, 1500 (mm) | ONE FACE | 3 (μm) | 5 (μm) |
| EXAMPLE 4 | MOLDING | SUS310 | HA | 200, 750, 1300 (mm) | ONE FACE | 4 (μm) | 12 (μm) |
| EXAMPLE 5 | MOLDING | SUS310 | HA | 90, 370, 750, 1130, 1410 (mm) | ONE FACE | 4 (μm) | 6 (μm) |
| EXAMPLE 6 | MOLDING | SUS310 | HA | 0, 370, 750, 1130, 1500 (mm) | ONE FACE | 4 (μm) | 6 (μm) |
| EXAMPLE 7 | MOLDING | INVAR MATERIAL | HA | 200, 750, 1300 (mm) | ONE FACE | 3 (μm) | 4 (μm) |
| EXAMPLE 8 | MOLDING | INVAR MATERIAL | HA | 90, 370, 750, 1130, 1410 (mm) | ONE FACE | 3 (μm) | 4 (μm) |
| EXAMPLE 9 | MOLDING | INVAR MATERIAL | HA | 0, 370, 750, 1130, 1500 (mm) | ONE FACE | 3 (μm) | 4 (μm) |
| EXAMPLE 10 | MOLDING | INVAR MATERIAL | HA | 200, 750, 1300 (mm) | TWO FACES | 2 (μm) | 4 (μm) |
| EXAMPLE 11 | MOLDING | INVAR MATERIAL | HA | 90, 370, 750, 1130, 1410 (mm) | TWO FACES | 2 (μm) | 2 (μm) |
| EXAMPLE 12 | MOLDING | INVAR MATERIAL | HA | 0, 370, 750, 1130, 1500 (mm) | TWO FACES | 2 (μm) | 2 (μm) |
| COMPARSION | WELDING | INVAR MATERIAL | HA | 0, 370, 750, 1130, 1500 (mm) | TWO FACES | 10 (μm) | 15 (μm) |

HA: HARD ALLOY

COATING APPARATUS AND COATING METHOD

BACKGROUND OF THE INVENTION

1. Field of the Invention

The present invention relates to a coating apparatus for and a coating method of coating a web with a coating solution which is discharged through lips of a die supported by a mounting, and more especially to a coating apparatus for and a coating method of coating a flexible web, such as a plastic film, a paper, a metal foil and the like, with a coating solution, such as a photosensitive emulsion agent, a magnetic liquid, a liquid for providing antireflective properties and antiglare properties, liquid for providing a view angle enlarging effect, a liquid pigment for a color filter, a surface protection liquid, and the like, so as to obtain a high functional multi-layer film.

2. Description Related to the Prior Art

In order to produce a multi-layer film having high functions, a coating apparatus including a die makes a coating of a web with coating solutions so as to form stacked layers from the coating solutions on the web. In recent years, in order to realize required functions, a technique for constructing the stacked layers at high accuracy with small wet film thickness at most 20 μm. In this case, the accuracy of each part in the coating apparatus is made higher such that the accuracy of a clearance between lips of the die and a web may be higher. Therefore, in Japanese Patent Laid-Open Publication No. 5-111672, a mounting and the die are formed from the same materials, and thus the difference of thermal expansion coefficient between the mounting and the die is smaller. Further, in Japanese Patent Laid-Open Publication No. 2000-176343, elements of the die are assembled on the mounting with keeping the temperature of the elements and the mounting at the same value as that for the coating. Furthermore, Japanese Patent Laid-Open Publication No. 2003-112100 describes demerits of assembling elements onto a die whose accuracy is not high. Further in this publication, in order to solve the problems of these demerits, an improvement of a method of fixing the die to the mounting is described.

However, in the above three publications, the consideration for increasing the accuracy of the mounting is not enough. Usually, the mounting is made by welding for easiness of the production. In the welding, however, it is difficult to produce the mounting with the accuracy in μm order. Therefore the increase of the accuracy of the clearance between the lips and the web is prevented. Further, in the above publications, it is not considered to keep the accuracy during the coating, but to increase the accuracy before the coating. Therefore, the accuracy of the clearance between the lips and the web decreases during the coating.

SUMMARY OF THE INVENTION

An object of the present invention is to provide a coating apparatus and a coating method forming plural superimposed layer at high accuracy by increasing a clearance accuracy between lips and a web.

Another object of the present invention is to provide a coating apparatus and a coating method of forming plural superimposed layer at high accuracy by keeping a clearance accuracy during a coating which has the largest influence on a quality of a product.

In order to achieve the object and the other object, a coating apparatus of the present invention includes a mounting and a die supported by the mounting. The mounting is obtained by grinding an integrally molded material. The die has lips between which a coating solution is discharged to a transported web for coating. Preferably, the mounting is formed of stainless.

In a preferably embodiment of the coating apparatus of the present invention, one of the lips is disposed in downstream side of a transporting direction from another one of the lips and formed to have such a straightness for the total length that a surface of the one lip in the downstream side has unevenness at most 5 μm in a widthwise direction of a coating. Each contact face of the mounting to the die and that of the die to the mounting are formed to have such a straightness for the total length that the each face has unevenness at most 5 μm in a widthwise direction of the coating.

Further, the one lip disposed in the downstream side is preferably formed from a hard alloy material in which carbide crystals having averaged diameter of 5 μm are combined. The hard alloy material is different from a material for a main body of the die. Furthermore, a coefficient of linear thermal expansion of the materials for the main body of the die is smaller than a coefficient of linear thermal expansion of the materials for forming the one lip in the downstream side of the transporting direction.

In another preferable embodiment of the coating apparatus of the present invention, the mounting includes heat retention holes for circuitously feeding hot water such that the temperature of the mounting before a coating may be almost equal to that during the coating.

The die is formed from material whose coefficient of linear thermal expansion is preferably at most $1.1\times10^{-5}$[1/K], and especially at most $6.0\times10^{-6}$[1/K].

In still another preferable embodiment of the coating apparatus of the present invention, the mounting and the die are fixed with use of bolts which are disposed in 100 mm from an edge of a widthwise direction of the die. Further, two faces of the die contact the mounting and are fastened to the mounting with the bolts.

Preferably, a gap between the lip and the web is at most 100 μm, and wet film thickness of the coating layer is at most 20 μm.

In a coating method of the present invention, the coating of the coating solution is made with the coating solution described above.

According to the coating apparatus of the present invention, since the mounting is obtained by grinding an integrally molded material, the accuracy of the mounting is increased, and the accuracy of the clearance between the lips and the web is increased. Further, since the mounting is made of stainless, endurance, workability and the like of the mounting are increased.

Further, one of the lips is disposed in downstream side of a transporting direction from another one of the lips and formed to have such a straightness for the total length that a surface of the one lip in the downstream side has unevenness at most 5 μm in a widthwise direction of a coating. Thus the unevenness of the surface is at most 5 μm in the widthwise direction. Furthermore, each contact face of the mounting to the die and that of the die to the mounting are formed to have such a straightness for the total length that the each face has unevenness at most 5 μm in a widthwise direction of the coating. Thus the unevenness of the surface is at most 5 μm in the widthwise direction. Therefore the accuracy of the clearance between the lips and the web is increased.

The one lip in the downstream side is preferably formed from a hard alloy material in which carbide crystals having averaged diameter of 5 μm are combined. The hard alloy material is different from a material for a main body of the die. Therefore, the deformation of the die is prevented in the change of the temperature and the accuracy of the clearance between the lips and the web is increased. Especially, a coefficient of linear thermal expansion of the materials for the main body of the die is smaller than a coefficient of linear thermal expansion of the materials for forming the one lip in the downstream side of the transporting direction. Thus the influence of the change of the temperature becomes smaller, and the accuracy of the clearance between the lips and the web is kept.

Since the mounting includes heat retention holes for circuitously feeding hot water such that the temperature of the mounting before a coating may be almost equal to that during the coating, the deformation of the die is prevented in the change of the temperature and the accuracy of the clearance between the lips and the web is increased.

Since the die is formed from material whose coefficient of linear thermal expansion is at most $1.1\times10^{-5}$[1/K], the deformation of the die is prevented in the change of the temperature and the accuracy of the clearance between the lips and the web is increased. Further, while the die is formed from material whose coefficient of linear thermal expansion is at most $6.0\times10^{-6}$[1/K], the deformation of the die is prevented more in the change of the temperature and the accuracy of the clearance between the lips and the web is increased more.

Since the mounting and the die are fixed with use of bolts which are disposed in 100 mm from an edge of a widthwise direction of the die, the deformation of the die is prevented in the change of the temperature and the accuracy of the clearance between the lips and the web is increased. Especially, while the two faces of the die contact the mounting and are fastened to the mounting with the bolts, the influence of the change of the temperature becomes smaller, and the accuracy of the clearance between the lips and the web is kept.

In the present invention, since the accuracy of the clearance between the lips and the web is increased, the accuracy of forming the coating layer becomes higher. Especially, the present invention is adequate to a coating process in which a gap between the lid and the web is at most 100 μm or in which wet film thickness of the coating layer is at most 2 μm. If the present invention is applied to these processes, the effects of the present invention are extremely large.

BRIEF DESCRIPTION OF THE DRAWINGS

The above objects and advantages of the present invention will become easily understood by one of ordinary skill in the art when the following detailed description would be read in connection with the accompanying drawings.

FIG. 3 is a table showing a clearance difference calculated from clearance in the slot die before and after the coating.

PREFERRED EMBODIMENTS OF THE INVENTION

In the present invention, several sorts of compounds may be used for a solvent. As such compounds, there are water, hydrocarbon halides, alcohols, ethers, esters, ketones and the like. Single one or a mixture thereof may be used as the solvent.

Further, as a flexible support, several sorts of web can be used. The web is, for example, a plastic film formed of polyethylene telephthalate, polyethylene-2,6-naphthalate, cellulose diacetate, cellulose triacetate, cellulose acetate propionate, polyvinyl chloride, polyvinylidene chloride, polycarbonate, polyimide, polyamide or the like. Otherwise, as the web, there are a paper and a multi-layer paper in which the paper is coated or laminated with α-polyolefines (each atom thereof has 2–10 carbon atoms), such as polyethylene, polypropylene, ethylene-butene copolymer, and the like. Further, the web may be a metal foil of aluminum, cupper, tin and the like, a material in which a preliminary layer is formed on a belt base, and a complex material in which the materials are stacked.

The web is coated with a coating solution for an optical compensation sheet, that for an antireflective film, a magnetic coating solution, a photosensitive coating solution, a solution for surface protection, an antistatic solution, a lubricant solution and the like. After the drying thereof, the film may be cut to have a predetermined length and width. As representative examples, there are an optical compensation sheet and the antireflection film and the like. However, the products from the web are not restricted in them.

Further, the present invention is not effective only in a single-layer coating but also a multi-layer sequential coating. The coating solution preferably has a viscosity in the range of 0.5 to 100 mPa·s, and a surface tension in the range of 20 to 70 mN/m. The coating speed is preferably at most 100 m/min.

Figure 1:
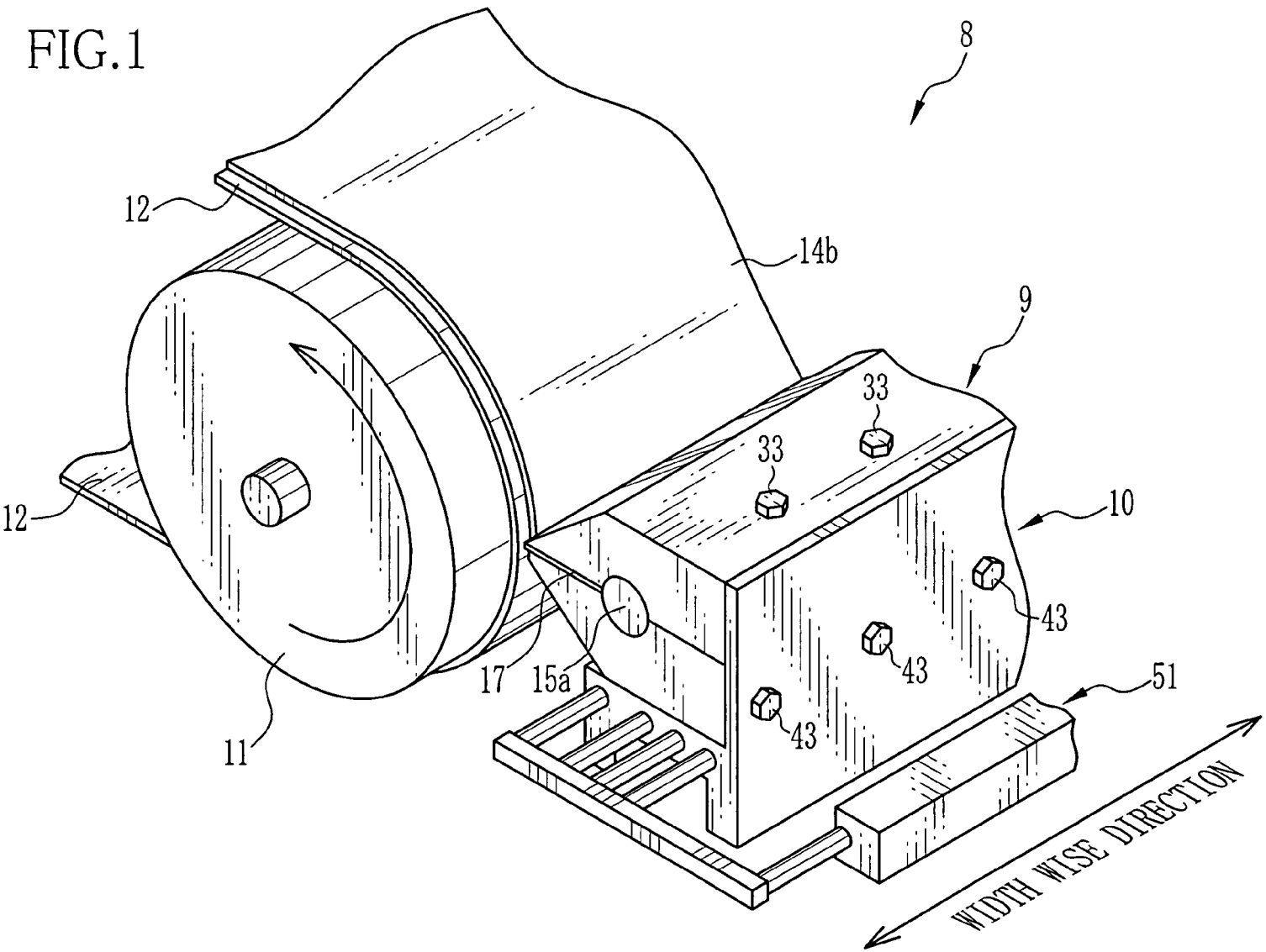
FIG. 1 is a perspective view of a coating apparatus in which a slot die is used.
Figure 2:
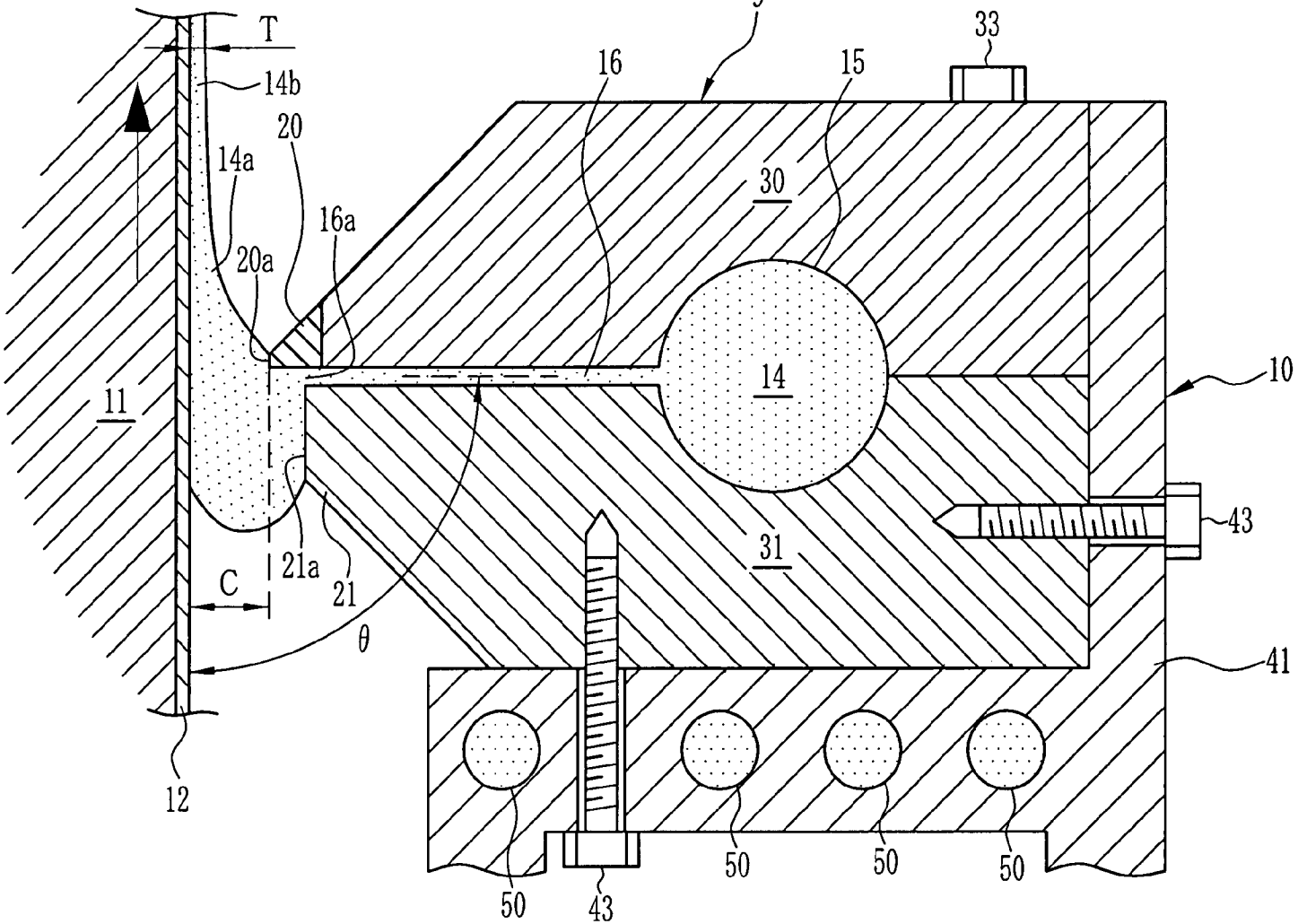
FIG. 2 is a sectional view of the coating apparatus.

As shown in FIGS. 1 and 2, a coating apparatus 8 includes a slot die 9 and a mounting 10 for holding the slot die 9. The slot die 9 discharges a coating solution 14 toward a web 12 continuously fed with support of back-up rollers 11. The discharged coating solution 14 forms a bead 14*a* between the slot die 9 and the web 12 to arrive at the web 12. Thus a coating layer 14*b* is formed on the web 12.

A pocket 15 and a slot 16 are formed in the slot die 9. The section of the pocket 15 has a linear line and a curved line, and for example, may be nearly circular or half circular. The pocket 15 has such a shape that a form in section is extended in a widthwise direction of the slot die 9, or in a perpendicular direction to a transporting direction of the web 12. A length of the pocket in a widthwise direction of the slot die 9 is usually the same as or slightly more than a casting width. The coating solution 14 is supplied into the pocket 15 from a side of the slot die 9 or through an opposite surface to an aperture 16*a* of the slot 16. Further, a pocket stopper 15*a* is provided for preventing the coating solution 14 from flowing out of the pocket 15. Thus the pocket 15 contains the coating solution 14.

The slot 16 is a flow path in which the coating solution flows from the pocket 15 to the web 12, and has the same sectional form in the widthwise direction of the slot die 9. The width of the discharged coating solution is regulated with a regulating plate 17 so as to be the almost same coating width as the casting width. An angle θ of the slot 16 to a transporting direction of the web 12 is preferably in the range of 30° to 90°.

The slot die 9 includes a downstream block 30 having a downstream lip 20 and an upstream block 31 having an upstream lip 21. The blocks 30,31 are formed so as to become slimmer and has a taper-like shape near the lips 20,21. Between the lips 20,21, the aperture 16*a* is formed. On tops of the lips 20,21 are respectively formed lands

20*a*,21*a* extending in a widthwise direction of the slot die 9. In an upstream side of the lips 20,21, or below the lips 20,21 in this figure, a decompression unit (not shown) is provided in an upstream side of the web 12 from the bead 14*a* without contacting the web 12, the bead 14*a* and the like for decompressing to sufficiently regulate the pressure. The decompression chamber includes a back-up plate and a side plate for keeping actuation efficiencies. Further, in this embodiment, the lips 20,21 are in an overbite position, in which the downstream lip 20 is disposed closer to the web 12 than the upstream lip 21. Thus a sufficient regulation of the pressure can be made.

The slot die 9 is an assembly constructed of plural parts, and main parts are the downstream block 30 in the downstream side of the web 12 and the upstream block 31 in the upstream side of the web 12. These blocks 30, 31 are fixed with bolts 33 and formed from materials whose coefficient of linear thermal expansion is at most $6.0\times10^{-6}$[1/K]. Since the blocks 30,31 are formed of such materials, the deformation of the blocks 30,31 in accordance with the variation of the temperature is prevented.

It is necessary that the structure of the downstream lip 20 in the downstream side close to the web 12 is especially accurate for forming the stacked layers at high accuracy in μm order. Therefore, the downstream lip 20 is formed from hard alloy (cemented carbide) which is a different material from a main body of the downstream block 30, and has such a straightness for the total length that a surface of the land 20*a* may have unevenness of at most 5 μm in a widthwise direction. Thus the unevenness of the surface is reduced to at most 5 μm in the widthwise direction. As the hard alloy, there are materials formed by binding a binder metal with a crystal of WC carbide, and the like, while the averaged diameter of particles of the crystal is at most 5 μm. Since these hard alloys are used, the surface becomes uniform, and the abrasion by the coating solution is prevented. (see, Japanese Patent Laid-Open Publication No.2003-200097).

The material used for forming a main body of each block 30,31 has a lower coefficient of linear thermal expansion than for forming the downstream lip 20. In each block 30,31, since the main body whose volume of each block 30,31 is larger than the downstream lip 20 has a lower coefficient of linear thermal expansion than the downstream lip 20, the influence of the deformation in accordance with the change of the temperature is decreased.

The slot die 9 is disposed on the mounting 10. If the accuracy of the mounting 10 is low, the slot die 9 cannot be held with high accuracy, and the accuracy of the clearance between the slot die 9 and the web 12 is decreased. Therefore, in the preset invention, the mounting 10 is formed by grinding a molded material. Thus the mounting 10 can be formed with accuracy in μm order. In this embodiment, the material of the mounting is stainless on account of endurance and workability.

An upper portion of the mounting 10 has a holder portion 41 having an L-shape. When the slot die 9 is disposed on the holder portion 41, an upper face of the holder portion 41 contacts to a lower face of the slot die 9, and a side face of the holder portion contacts to a rear face of the slot die 9. The lower and rear faces of the slot die 9 and the upper and side faces of the holder portion 41 are grinded so as to have the straightness for the total length. Thus the unevenness is reduced to at most 5 μm, and therefore the slot die 9 can be held with high accuracy.

Further, the slot die 9 is positioned and then the back and faces of the upstream block 31 are fastened with bolts for fixing the mounting 10 such that a clearance C to the web 12 may be a predetermined value. Thus, since two faces of the slot die 9 are fastened to the mounting 10, the slot die 9 is stably held by the mounting 10 and any part of the slot die 9 is not away from the mounting 10. Further, the bolts 43 are arranged in the widthwise direction of the slot die 9, and at least one of the bolts 43 is disposed in 100 mm from an edge in the widthwise direction. Thus it is prevented that the temperature varies to deform the slot die 9.

Further, the mounting 10 is provided with heat retention holes 50 through which a feeding device 51 circuitously feeds hot water. The feeding device 51 adjusts the temperature of the hot water to be fed, such that the temperature of the slot die 9 at the fixing to the mounting 10 may be the same as that during the coating. Thus it is prevented to deform the slot die 9 variation of the temperature.

As described above, in the present invention, the slot die 9 is not only formed with high accuracy, but also the mounting 10 for holding the slot die 9 is formed with high accuracy by grinding the integrally molded material. Consequently, the accuracy of the clearance of the slot die to the web becomes higher. Further, in the present invention, the change of the clearance in influence of the outer elements (such as the change of the temperature) is reduced by improving the materials of the slot die and the mounting, and the fixing method of the slot die to the mounting. Thus the higher accuracy of the clearance can be kept during the coating. Note that the integrally molded material means a single one or an integral combination of materials produced by the molding.

The present invention can be applied to several processes, such as a coating process in which the clearance C of the lips to the web is at most 100 μm, a coating process in which wet film thickness T is at most 20 μm, a process in which a slight error has a large influence on quality of the products. In these processes, the multi-layer film can be formed with high accuracy.

In the present invention, the mounting for holding the die may be formed by grinding the integrally molded materials. Therefore the present invention is not restricted in the coating process with use of the slot die as described above, and may be applied to a process of a slide beat coating. Further, the shapes of the die and mounting, and the concrete accuracy of each parts are not restricted in the above embodiment, and can be changed adequately.

For example, in the above embodiment, the lower and rear faces of the die are fastened by the bolts. However, as described in Japanese Patent Laid-Open Publication No. 2003-112100, the die is sandwiched on upper and lower faces for fixing. Furthermore, the fixation of the die is preferably made on two faces thereof. However, if the fixation on two faces is difficult, the fixation of the die may be made on one face.

Further, in the above embodiment, the hot water is circuitously fed such that the temperature of the mounting at the fixation of the die to the mounting may be the same as that during the casting. However, the circulate feed of the hot water may be made such that the temperature of the mounting during the coating may be the same as that at the fixation of the die to the mounting.

Preferably, the temperature in a production of the die and the grinding of the mounting is almost the same as the temperature during the coating. Thus it is prevented to deform the die and the mounting in the variation of the temperature, and the higher accuracy of the clearance between the lips and the web can be kept during the coating.

In following, an experiment of the present invention will be explained, in compared with concrete examples and comparisons. In this experiment, coating processes for the examples and comparisons were provided in an already-known production process of an optical compensation sheet. In this production process, the web was transported by a transferring device, and passed on a rubbing roller with support of guide rollers. The coating process was performed thereafter. Further, the web was transported through the drying zone and the heating zone, and then an UV-ray was applied to the transported web from the UV-ray lamp. Then the web was wound by a winding device.

As the web in the examples and comparisons, triacetyl cellulose (Fuji tack, Fuji Photo Film Co. LTD), 100 μm in thickness, was used. Before the coating, 25 ml/$m^2$ of 2 wt. % solution of chain alkyl denaturated polyvinyl alcohol (Poval MP-203, Kuraray Co. Ltd.) was applied on a surface of the web, and dried in 60° C. for a minute to form a polymer layer. Then the web was fed, and a rubbing processing is carried out on a surface of the polymer layer to form an orientation layer. Thereafter the web was transported into the coating process for performing the coating. A pressure of a rubbing roll is applied at $9.8\times10^{-3}$ Pa and a rotational speed is 5.0 m/sec during the rubbing processing.

In the examples and comparisons, the die was 1500 mm in width and held by the mounting, and then the coating solution was applied to the web from the die. Methylethylketone was use as a solvent of the coating solution. In order to prepare this coating solution, optical polymerization initiator (Irgacure 907, Chiba Gaigy Japan) was added to a mixture of discotic compounds TE-(1) and TE-(2) (as shown in Chemical Formula 1) in ratio of 4:1 (TE-(1):TE-(2)) such that the content of the optical polymerization initiator to the coating solution may be 1 wt %. The content of the discotic compounds (or liquid crystalline compounds) in the coating solution was a 40 wt. %. Note that the temperature of the coating solution was 23° C. The transporting speed of the web was 50 m/min. Further, the degree of decompression was 1600 Pa. The web, after the coating of the coating solution thereon, passed through the drying section and the heating section, whose temperatures were respectively adjusted to 100° C. and 130° C. Thus the ultraviolet rays was irradiated by the ultraviolet lamp (air-cooled type metal halide lamp of 160 W/cm, produced by Eyegraphics Co., Ltd.) to the liquid crystal layer on the surface of the web.

TE

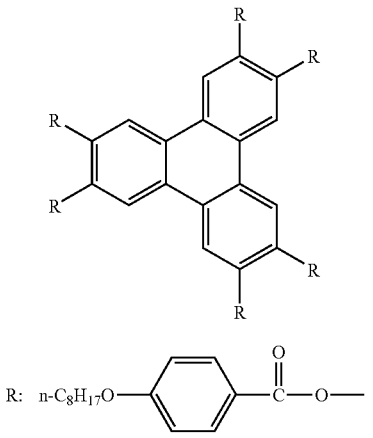

(1)

-continued

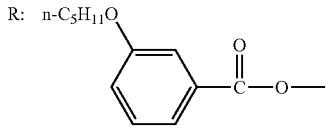

(2)

EXAMPLES 1–3

In Examples 1–3, the mounting was obtained by grinding the integrally molded material. A main body of the slot die was formed from SUS630, the downstream lip was formed from hard alloy. The rear face of the slot die was fastened with the bolts. In Example 1, the bolts were disposed 200 mm, 750 mm, 1300 mm apart from an edge of the slot die in the widthwise direction. In Example 2, the bolts were disposed 90 mm, 370 mm, 750 mm, 1130 mm, 1410 mm apart from an edge of the slot die in the widthwise direction. In Example 3, the bolts were disposed 0 mm, 370 mm, 750 mm, 1130 mm, 1500 mm apart from an edge of the slot die in the widthwise direction.

EXAMPLES 4–6

In Examples 4–6, the mounting was obtained by grinding the integrally molded material. A main body of the slot die was formed from SUS310, the downstream lip was formed from hard alloy. The rear face of the slot die was fastened with the bolts. In Example 4, the bolts were disposed 200 mm, 750 mm, 1300 mm apart from an edge of the slot die in the widthwise direction. In Example 5, the bolts were disposed 90 mm, 370 mm, 750 mm, 1130 mm, 1410 mm apart from an edge of the slot die in the widthwise direction. In Example 6, the bolts were disposed 0 mm, 370 mm, 750 mm, 1130 mm, 1500 mm apart from an edge of the slot die in the widthwise direction.

EXAMPLES 7–9

In Examples 7–9, the mounting was obtained by grinding the integrally molded material. A main body of the slot die was formed from invar materials (name of commodity, K-EL70, produced by Touhoku Tokusyukou Co. Ltd.), and the downstream lip was formed from hard alloy. The rear face of the slot die was fastened with the bolts. In Example 7, the bolts were disposed 200 mm, 750 mm, 1300 mm apart from an edge of the slot die in the widthwise direction. In Example 8, the bolts were disposed 90 mm, 370 mm, 750 mm, 1130 mm, 1410 mm apart from an edge of the slot die in the widthwise direction. In Example 9, the bolts were disposed 0 mm, 370 mm, 750 mm, 1130 mm, 1500 mm apart from an edge of the slot die in the widthwise direction.

EXAMPLES 10–12

In Examples 10–12, the mounting was obtained by grinding the integrally molded material. A main body of the slot die was formed from invar materials (name of commodity, K-EL70, produced by Touhoku Tokusyukou Co. Ltd.), and the downstream lip was formed from hard alloy. The rear and lower faces of the slot die were fastened with the bolts. In Example 10, the bolts were disposed 200 mm, 750 mm, 1300 mm apart from an edge of the slot die in the widthwise direction. In Example 11, the bolts were disposed 90 mm, 370 mm, 750 mm, 1130 mm, 1410 mm apart from an edge of the slot die in the widthwise direction. In Example 12, the bolts were disposed 0 mm, 370 mm, 750 mm, 1130 mm, 1500 mm apart from an edge of the slot die in the widthwise direction.

COMPARISON

In Comparison, the mounting was produced by welding invar materials, and the other conditions were the same as Examples 12 whose result was the best in this experiment as described below.

ESTIMATION

In Examples 1–12 and Comparison the clearance between the downstream lip and the web was measured before and after coating for one hour, and the clearance difference as a difference of the minimal value from the maximal value of the clearance was calculated and determined as a clearance difference. The results of the measurement were shown in FIG. 3.

In Example 12, both of the clearance differences before and after the coating are the smallest, and the difference of the clearance difference before the coating from that after the coating was the smallest in this experiment. Therefore the result of Example 12 was the best in this experiment.

As a result, the clearance difference was small both after and before the coating and the clearance accuracy was larger when the mounting was obtained by grinding the integrally molded materials than by welding the stainless materials.

Further, the main body of the slot die was formed from the invar materials, and the bolts for fixing the slot die to the mounting were positioned near the edge of the slot die. Thus the difference of clearance difference after the coating from that before the coating was small, and the clearance accuracy was kept during the coating. Further, since the slot die was fixed to the mounting on two faces, the clearance difference was small before and after the coating. Thus in the present invention, the accuracy of the clearance was improved and kept.

Various changes and modifications are possible in the present invention and may be understood to be within the present invention.

What is claimed is:

1. A coating apparatus for coating a web with a coating solution to form a coating layer, comprising:

a mounting obtained by grinding an integrally molded material; and a die supported by said mounting, said coating solution being discharged between lips of said die, wherein one of said lips is disposed on the downstream side of a transporting direction of said web from another one of said lips and formed to have such a straightness for its total length that unevenness of a surface of said one lip on the downstream side is at most 5 μm in a widthwise direction of the coating, and each contact face of said mounting to said die and that of said die to said mounting are formed to have such a straightness for its total length that said unevenness of each face is at most 5 μm in a widthwise direction of the coating.

2. A coating apparatus as defined in claim 1, wherein said mounting is formed of stainless.

3. A coating apparatus as defined in claim 1, wherein said one lip disposed on said downstream side is formed from a hard alloy material in which carbide crystals having average diameter of 5 μm are bound, and said hard alloy material is different from a material for a main body of said die to which said lips are attached.

4. A coating apparatus as defined in claim 3, wherein a coefficient of linear thermal expansion of said materials for said main body of said die is smaller than a coefficient of linear thermal expansion of said materials for forming said one lip on said downstream side of said transporting direction.

5. A coating apparatus as defined in claim 1, wherein said mounting includes heat-retention holes for circuitously feeding hot water such that the temperature of said mounting before the coating may be almost equal to that during the coating.

6. A coating apparatus as defined in claim 1, wherein said die is formed from material whose coefficient of linear thermal expansion is at most $1.1\times10^{-5}$[1/K].

7. A coating apparatus as defined in claim 6, wherein said die is formed from material whose coefficient of linear thermal expansion is at most $6.0\times10^{-6}$[1/K].

8. A coating apparatus as defined in claim 1, wherein said mounting and said die are fastened with bolts, and said bolts are disposed in 100 mm from an edge of a widthwise direction of said die.

9. A coating apparatus as defined in claim 8, wherein said die includes at least two contact faces which are fastened to said mounting with said bolts.

10. A coating apparatus as defined in claim 1, wherein a clearance between said lips and said web is at most 100 μm.

11. A coating apparatus as defined in claim 1, wherein wet film thickness of said coating layer is at most 20 μm.

* * * * *